United States Patent [19]

Harvey, Sr

[11] Patent Number: 5,058,849

[45] Date of Patent: Oct. 22, 1991

[54] RETENTION DEVICE

[76] Inventor: Louis A. Harvey, Sr, 15107 Ilene, Detroit, Mich. 48238

[21] Appl. No.: 542,913

[22] Filed: Jun. 25, 1990

[51] Int. Cl.[5] ..... A47B 97/02

[52] U.S. Cl. ..... 248/442.2; 248/918; 248/231.8; 248/316.8; 248/229

[58] Field of Search ..... 248/442.2, 229, 231.8, 248/316.8, 918

[56] References Cited

U.S. PATENT DOCUMENTS

| | | | |
|---|---|---|---|
| 1,065,685 | 6/1913 | Hibbard | 248/231.84 |
| 1,130,559 | 3/1913 | Allen | 248/442.2 |
| 1,188,675 | 6/1916 | Olive | 248/442.2 |
| 2,236,133 | 3/1941 | Croninger et al. | 248/442.2 |
| 4,354,300 | 10/1982 | Anderle | 248/229 X |

FOREIGN PATENT DOCUMENTS

| | | | |
|---|---|---|---|
| 171709 | 9/1916 | Canada | 248/442.2 |
| 611207 | 5/1979 | Czechoslovakia | 248/442.2 |

*Primary Examiner*—Alvin C. Chin-Shue
*Attorney, Agent, or Firm*—Peter D. Keefe

[57] ABSTRACT

A retention device which interacts biasably with a primary object to hold a secondary object at a predetermined location with respect to the primary object. A retention spring has a humped section and feet at either end for pressably interacting with the primary object and the surface on which it rests. Connected with the retention spring is a retention member for retaining the secondary object thereto in a fixed relationship with respect to the primary object. In operation the retention spring is inserted between the bottom of the primary object, such as a typewriter or microwave oven, and the surface on which the primary object rests, such as a desk or table top. The humped section of the retaining spring is biasably forced into a less humped configuration by the bottom of the primary object and the resting surface thereby biasably holding the retaining spring in relation to the primary object. The secondary object, such as a rack or a paper holder, may now be connected with the retention member and thereby the secondary object will be reliably retained relative to the primary object.

2 Claims, 1 Drawing Sheet

RETENTION DEVICE

BACKGROUND OF THE INVENTION

1. Field of the Invention

The present invention relates to devices which hold a secondary object in place relative to a primary object, and more particularly to a spring which serves this function.

2. Description of the Prior Art

Frequently there is a need to hold a secondary object adjacent or near a primary object. One example would be a holder for papers located next to a typewriter so that a typist may readily see what he/she needs to type.

Generally, devices which hold a secondary object at a predetermined location relative to a primary object either are structured to stand alone, such as a device constructed in the form of a tripod, or to interconnect with the primary object, such as by bolting or by a releasable fastener along the lines of a hook and loop type fastener.

What is needed is a device which can retain a secondary object in the vicinity of a primary object easily, reliably and without need for fastening to the primary object or for the device to stand alone, on its own.

SUMMARY OF THE INVENTION

The present invention is a retention device which interacts biasably with a primary object to hold a secondary object at a predetermined location with respect to the primary object.

A retention spring has a humped section for interacting with the primary object and a pair of feet at either end. A retention member is connected with one of the feet for retaining the secondary object in a fixed relationship with respect to the primary object.

In operation, the retention spring is inserted between the bottom of the primary object, such as a typewriter or microwave oven, and the surface on which the primary object rests, such as a desk or table top. The humped section of the retaining spring is biasably forced into a less humped configuration by the bottom of the primary object and the surface on which it rests, thereby biasably holding the retaining spring in fixed relation with respect to the primary object. The secondary object, such as a rack or a paper holder, may now be connected with the retention member so that the secondary object will be thereby reliably retained relative to the primary object.

Accordingly, it is an object of the present invention to provide a retention device which biasably interacts with a primary object in order to hold a secondary object in a fixed relationship with respect to the primary object.

It is an additional object of the present invention to provide a retention device which biasably interacts with a primary object in order to hold a secondary object in a fixed relationship with respect to the primary object, wherein a retaining spring is held relative to the primary object by a hump section thereof.

It is a further object of the present invention to provide a retention device which biasably interacts with a primary object in order to hold a secondary object in a fixed relationship with respect to the primary object, wherein a retaining spring is held relative to the primary object by a hump section thereof, and a retention member connected to the retaining spring is structured to retain the secondary object relative to the primary object.

It is another object of the present invention to provide a retention device which biasably interacts with a primary object in order to hold a secondary object relative thereto, no fastener being required therefor.

These, and additional objects, advantages, features and benefits of the present invention will become apparent from the following specification.

DETAILED DESCRIPTION OF THE PREFERRED EMBODIMENTS

Figure 1:
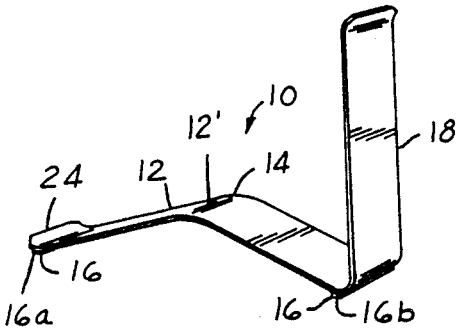
FIG. 1 is a frontal perspective view of a first preferred embodiment of the retention device according to the present invention.

Referring now to the Drawing, the Figures show three examples of preferred structures of the retention device, each such retention device structure including a preferred embodiment of the retention spring 10. It is preferred to construct the retention spring of a spring steel, but other resilient materials, including those of a metallic, plastic or composite nature, may be utilized. The retention spring 10 is shaped with a hump 12 that is preferred to be located at, or near, the center 14. The hump 12 provides an apex 12' for the retention spring 10. It is preferred to include pads 16 constructed of soft, resilient material which are located on the feet **16*a* and 16*b*** of the retention spring.

Figure 2:
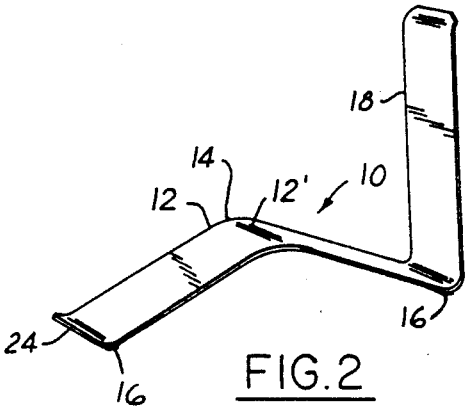
FIG. 2 rearward perspective view of the retention device depicted in FIG. 1.
Figure 3:
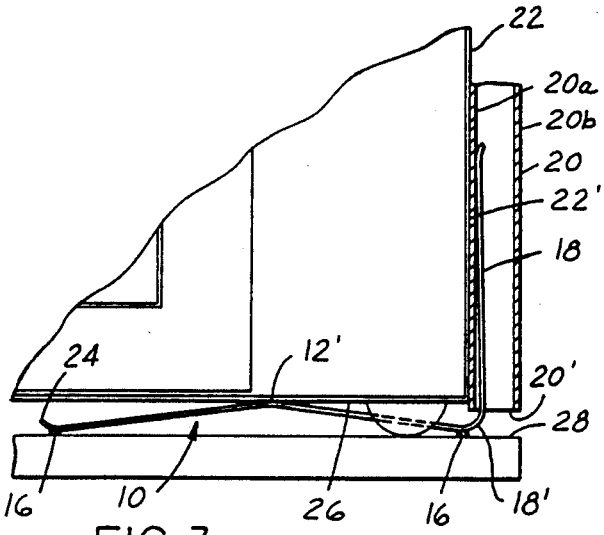
FIG. 3 is a part sectional side view of the first preferred embodiment of the present invention shown in operation.

Referring now specifically to FIGS. 1 through 3 a first preferred form of retention device is depicted. At one end of the retention spring 10 is located a first preferred form of retention member 18 in the form of an upright which is integrally connected with the retention spring. An example of operation of this retention device is shown in FIG. 3 in which a utensils rack 20 is held adjacent a microwave oven 22 via the retention device, as follows. The forward end 24 of the retention spring 10 is inserted underneath the bottom 26 of the microwave 22 until the retention member 18 is firmly positioned against a sidewall 22' of the microwave. The hump 12 is sufficiently exaggerated so that the apex 12' has a displacement relative to the pads 16 that is higher than the distance between the bottom 26 of the microwave and the table top 28. This difference in displacement causes the hump 12 to be compressed as the apex 12' is forced under the microwave. Accordingly, the biasable tension of the apex 12' against the bottom 26 of the microwave causes the pads 16 to press against the table top 28. Thus, at the apex and the pads, friction is established which retains the retention member firmly against the sidewall 22'. Now an inner wall **20*a* of the utensils rack 20 (the utensils rack having an open lower end 20'), may be forced between the sidewall 22' and the retention member 18, thereby firmly securing the utensils rack 20 to the sidewall of the microwave 22. Utensils (not shown) may now be mounted to the outer wall 20*b* of the utensils rack 20. As depicted in FIG. 3, in order to provide a maximum degree of operative effectiveness, it is preferred that the retention member 18 be bent at its interconnection location 18' slightly in the direction of the forward end 24** of the retention spring.

Figure 4:
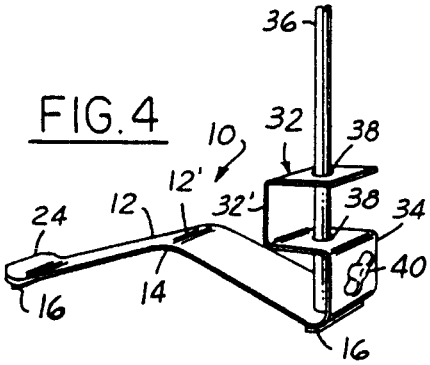
FIG. 4 is a frontal perspective view of a second preferred embodiment of the retention device according to the present invention.
Figure 6:
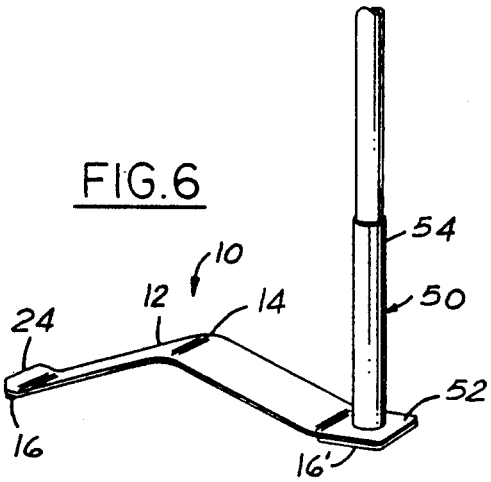
FIG. 6 is a frontal perspective view a variation in the second preferred embodiment of the present invention.
Figure 5:
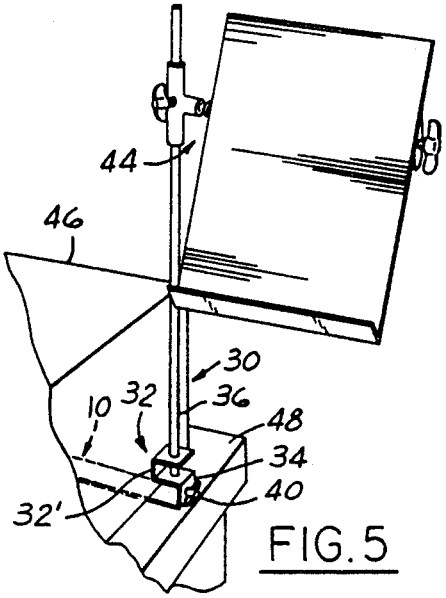
FIG. 5 is a perspective view of the second preferred embodiment of the present invention shown in operation.

FIGS. 4 through 6 show variations in the kinds of retention members that can be interconnected with the retention spring 10 to form retention devices according to the present invention.

FIGS. 4 and 5 show one variation of retention member 30 that is integrally connected to the retention spring. In this retention device, a U-shaped upright holder 32 is connected by a flange member 34 to a foot 16 of the retention spring. An upright in the form of a rod 36 is inserted through apertures 38 provided in the U-shaped upright holder 32. A set screw 40 in the flange member 34 provides for securing the rod 36 in relation to the U-shaped upright holder 32. The upper end 42 of the rod may, as shown in FIG. 5, support a paper holder 44 or any other object, as desired. As depicted in FIG. 5, the retention spring 10 has been thrust between a typewriter 46 and a table top 48, and the retention spring will secure relative to the typewriter as described above with respect to the microwave example. In this case, the central section 32' of the U-shaped upright holder 32 is located against the typewriter 46.

FIG. 6 depicts yet a further possible configuration for a retention device in which a retention member 50 is composed of a base 52 and an upright in the form of an upstanding rod 54 connected with the base. It is preferred that the pad 16' under the base 52 be dimensioned commensurate with the preferred extended dimension of the base, as shown in FIG. 6.

It will be understood from the foregoing description, that the retention spring 10 is structured to interface with some primary object in which there is a preset clearance between the bottom of the primary object and the surface on which it rests. The hump of the retention spring must be such that the apex is displaced further in relation to the feet, in particular the pads, a distance substantially greater that the preset clearance. Thus, when the retention spring is inserted between the bottom of the primary object and the surface upon which it rests, the apex interacts with the bottom of the primary object and the feet interact with the surface on which the primary objects rests so as to thereby cause the hump to biasably flatten. Consequently, bias force is applied by the retention member at the apex to the primary object and at the feet, in particular the pads, to the surface on which the primary object rests.

It will be further understood that the retention member may be in any suitable form for the particular purpose to which it is to be put, such as, but not limited to, holding a secondary object against the primary object, as depicted in FIG. 3, or holding a secondary object in a fixed location relative to the primary object, as depicted in FIG. 5.

To those skilled in the art to which this invention appertains, the above described preferred embodiment may be subject to change or modification. For instance, while the foregoing description has referenced the retention spring interacting between the primary object and its resting surface, it is within the scope of this disclosure to include utilization of the retention spring with respect to the primary object alone, such as by inserting the retaining spring into a slot therein, or with respect to the primary object and any other surface. Such change or modification can be carried out without departing from the scope of the invention, which is intended to be limited only by the scope of the appended claims.

What is claimed is:

1. A retention device for retaining a secondary object relative to a primary object, wherein said primary object includes slot means, said retention device comprising:

a retention spring constructed of a resilient material having a first end, a second end, a first side and a second side, said retention spring having a first foot located at said first end and a second foot located at said second end, each said first and second feet being located on said first side of said retention spring, said retention spring having a hump located between said first foot and said second foot, said hump having an apex, said apex being located on said second side of said retention spring, said first and second feet being covered by a pad of soft, resilient material; and a retention member interconnected with said second end of said retention spring, said retention member being oriented substantially perpendicular with respect to said second foot in a direction substantially normal to said second side of said retention spring at said second foot thereof;

wherein said retention spring may be inserted with said first end first into the slot means of the primary object such that said apex and said first and second feet will biasably press thereagainst so as to retain said retention spring in a fixed location relative to the primary object and the secondary object may be connected with the retention member so as to retain the secondary object relative to the primary object;

wherein further said retention member is integral with said retention spring, said retention member being constructed of said resilient material; wherein said retention member may biasably press against the secondary object so as to retain the secondary object adjacent the primary object.

2. A retention device for retaining a secondary object relative to a primary object, wherein said primary object has a bottom separated a predetermined distance from a resting surface therefor, said retention device comprising:

a retention spring constructed of a resilient material having a first end, a second end, a first side and a second side, said retention spring having a first foot located at said first end and a second foot located at said second end, each said first and second feet being located on said first side of said retention spring, said retention spring having a hump located between said first foot and said second foot, said hump having an apex, said apex being located on said second side of said retention spring, said first and second feet being covered by a pad of soft, resilient material; and a retention member interconnected with said second end of said retention spring, said retention member being oriented substantially perpendicular with respect to said second foot in a direction substantially normal to said second side of said retention spring at said second foot thereof;

wherein said retention spring may be inserted with said first end first between the bottom of the primary object and the resting surface such that said apex and said first and second feet will biasably press respectively thereagainst so as to retain said retention spring in a fixed location relative to the primary object and the secondary object may be connected with the retention member so as to retain the secondary object relative to the primary object;

wherein further said retention member is integral with said retention spring, said retention member being constructed of said resilient material; wherein said retention member may biasably press against the secondary object so as to retain the secondary object adjacent the primary object.

* * * * *